US009670595B2

(12) United States Patent
Huang et al.

(10) Patent No.: US 9,670,595 B2
(45) Date of Patent: Jun. 6, 2017

(54) PROCESS FOR LAYING FIBROUS WEBS FROM A CENTRIFUGAL SPINNING PROCESS

(71) Applicant: E I DU PONT DE NEMOURS AND COMPANY, Wilmington, DE (US)

(72) Inventors: Tao Huang, Downingtown, PA (US); Jack Eugene Armantrout, Richmond, VA (US); Thomas William Harding, Wilmington, DE (US); Thomas Patrick Daly, Aston, PA (US); Jay J Croft, Middletown, DE (US); Carl Saquing, Newark, DE (US); Glenn Creighton Catlin, Newark, DE (US)

(73) Assignee: E I DU PONT DE NEMOURS AND COMPANY, Wilmington, DE (US)

( * ) Notice: Subject to any disclaimer, the term of this patent is extended or adjusted under 35 U.S.C. 154(b) by 0 days.

(21) Appl. No.: 14/364,708

(22) PCT Filed: Dec. 20, 2012

(86) PCT No.: PCT/US2012/071047

§ 371 (c)(1),
(2) Date: Jun. 12, 2014

(87) PCT Pub. No.: WO2013/096672

PCT Pub. Date: Jun. 27, 2013

(65) Prior Publication Data

US 2016/0047061 A1 Feb. 18, 2016

Related U.S. Application Data

(60) Provisional application No. 61/578,278, filed on Dec. 21, 2011.

(51) Int. Cl.

| | |
|---|---|
| ***D01D 5/18*** | (2006.01) |
| ***D01D 5/00*** | (2006.01) |
| ***D04H 1/732*** | (2012.01) |
| ***D04H 1/4334*** | (2012.01) |
| ***D04H 1/435*** | (2012.01) |
| ***D04H 1/4358*** | (2012.01) |
| ***D04H 1/736*** | (2012.01) |
| ***D01D 10/00*** | (2006.01) |

(52) U.S. Cl.

CPC ..... *D01D 5/0061* (2013.01); *D01D 5/18* (2013.01); *D01D 10/00* (2013.01); *D04H 1/435* (2013.01); *D04H 1/4334* (2013.01); *D04H 1/4358* (2013.01); *D04H 1/732* (2013.01); *D04H 1/736* (2013.01); *D10B 2321/022* (2013.01); *D10B 2331/04* (2013.01)

(58) Field of Classification Search

CPC D04H 1/728; D01D 5/18; D01D 5/00; D01D 10/10

USPC ..... 264/468

See application file for complete search history.

(56) References Cited

U.S. PATENT DOCUMENTS

| | | | | |
|---|---|---|---|---|
| 2,587,740 | A | 3/1952 | Laughlin | |
| 3,097,085 | A | 7/1963 | Wallsten | |
| 4,277,436 | A * | 7/1981 | Shah | C03B 37/048 264/176.1 |
| 4,348,341 | A * | 9/1982 | Furuya | C04B 35/62236 264/14 |
| 5,076,826 | A * | 12/1991 | Teeter | C03B 37/048 65/460 |
| 5,494,616 | A | 2/1996 | Voelker et al. | |
| 8,277,711 | B2 | 10/2012 | Huang et al. | |
| 2006/0012084 | A1 * | 1/2006 | Armantrout | D01D 5/0985 264/465 |
| 2006/0290031 | A1 | 12/2006 | Jirsak et al. | |
| 2008/0242171 | A1 * | 10/2008 | Huang | D01D 5/0023 442/51 |
| 2009/0127748 | A1 | 5/2009 | Takahashi | |
| 2009/0160099 | A1 | 6/2009 | Huang | |

FOREIGN PATENT DOCUMENTS

| | | | |
|---|---|---|---|
| JP | 2009041128 | | 2/2009 |
| JP | 2010001592 | | 1/2010 |
| KR | 100289250 | B1 | 5/2001 |
| KR | 10-0780346 | * | 11/2007 |
| KR | 100780346 | B1 | 11/2007 |

OTHER PUBLICATIONS

KR 10-0780346, Kim Chan, Nov. 2007, machine translation.*
KR 10-0780346, Claims, Kim Chan, Nov. 2007, machine translation.*

* cited by examiner

*Primary Examiner* — Mark Halpern

(57) ABSTRACT

A method for laying down a nanoweb of nanofibers from a centrifugal spinning process by a combination of an air flow field and a charging arrangement. Fibrous streams in the form of fibrils of molten polymer or polymer solution are discharged from a rotating member into an air flow field that is essentially parallel to the direction of discharge of fibrils at the point of discharge of the fibrils. The fibrous streams are attenuated and directed by means of the air flow field onto the surface of a collector to form a nanoweb. The fibrous streams are charged along all or at least a portion of their route from the point of discharge to the surface of the collector.

1 Claim, 20 Drawing Sheets

PROCESS FOR LAYING FIBROUS WEBS FROM A CENTRIFUGAL SPINNING PROCESS

This application is a 371 of PCT/US2012/071047 filed 20 Dec. 2012

This application claims priority under 35 U.S.C. §119(e) from, and claims the benefit of, U.S. Provisional Application No. 61/578,278, filed 21 Dec. 2011, which is by this reference incorporated in its entirety as a part hereof for all purposes.

TECHNICAL FIELD

This invention relates to methods involving a fiber lay-down process for forming fibrous webs. In particular, very fine fibers can be made and collected into a fibrous web useful for selective barrier end uses such as in the fields of air and liquid filtration and battery and capacitor separators.

BACKGROUND

Centrifugal atomization processes are known in the art for making metal, metal alloy and ceramics powders. Centrifugal spinning processes are known in the art for making polymer fibers, carbon pitch fibers and glass fibers, such as disclosed in U.S. Pat. Nos. 3,097,085, 2,587,710 and 8,277,711

In order to produce useful webs from such fibers, however, there is a need to be able to lay down the fibers in a suitable configuration. In particular, the problem is complicated by the fact that fibers are being formed centrifugally from a rotating device, and the transition from a rotating fiber flow pattern to a flat sheet with desired properties such as configuration and uniformity can be difficult to achieve. A need thus remains for a method for easily forming webs of high quality and uniformity.

SUMMARY

The present invention is directed to a method for laying down a web of nanofibers from a centrifugal spinning process by employing a combination of an air flow field and electrostatic charging of the fibers relative to a collector. The method comprises the steps of (i) discharging fibrous streams in the form of fibrils or fibers of molten polymer or polymer solution from a rotating member into an air flow field that is essentially parallel to the direction of discharge of fibrils at the point of discharge of the fibrils, (ii) attenuating the fibrous streams, and (iii) directing the attenuated fibrous streams by means of an air flow field onto the surface of a collector to form a nanoweb.

The fibrous streams are electrically charged along all or at least a portion of their route from the point of discharge to the surface of the collector In one embodiment, the web laid down by the process may have a uniformity index in a range of about 0.1 to about 5 when measured on a sample size of 90 by 60 cm at 3000 by 2000 pixels.

The nanofibers may be directed to the collector by a shaping air flow that is essentially perpendicular to the collector surface. The air flow field at step (iii) above may further comprise a flow of air into at least a portion of the collector surface were the flow of air is essentially perpendicular to the collector from a region between the body of the rotating member and the collector surface.

The air flow field at step (i) may also comprise air from a nozzle that has an opening that is located on a radius of the cup or disk, and the air flow is directed at an angle to the radius of between 0 and 60 degrees and in a direction opposite to the direction of rotation of the disk.

The rotating member of the method may comprise a disk or cup and fibrils are discharged from the edge of the surface of said disc or cup or from orifices located in or on the surface or cup.

The fibrils or fibers may attain their electric charge relative to the collector by the application of an electric charge to the rotating member, the fibrils, the collector surface, a structure located in the vicinity of the collector surface, or any combination of these locations and the charge is relative to a ground located on rotating member, the fibrils, the collector surface, a structure located in the vicinity of the collector surface, or any combination of these locations. The charge may also be applied to the fibrils by an ion flow produced by a corona discharge or by other means such as a radio frequency discharge.

The invention is also directed to a method for laying down a nanoweb from a centrifugal spinning process comprising the steps of:

(i) ejecting a polymer melt in air or an inert gas from a surface of a spinning disk or cup rotating about an axis and located in a spinning head, wherein molten fibrils exit the surface in a direction essentially perpendicular to the axis of rotation of the disc or cup and into an electric field established between a fiber collector and the spinning head; and wherein the fibrils are attenuated by the centrifugal force and cool to form nanofibers that have a number average fiber diameter of less than 1,000 nm;

(ii) applying a charge to the polymer melt, the molten fibrils, the nanofibers, or any combination of these three locations;

(iii) directing the nanofibers with a shaping air flow towards a collector that has a charge opposite to the charge on the fibers in (ii) above; and (iv) collecting the polymeric nanofibers on the collector; wherein turbulent motion of air located between the spinning head and the collector is suppressed by air jets.

In this embodiment, a region exists adjacent to and touching the collector where the motion of the fibers is governed by the potential difference between the nanofibers and the collector and is unaffected by the shaping air flow. The air jets may be issued from a nozzle that has an opening that is located on a radius of the cup or disk, and the air flow is directed at an angle to the radius of between 0 and 60 degrees and in a direction opposite to the direction of rotation of the disk.

The invention is also directed in a further embodiment to a nanoweb made by any of the processes described above.

In a further embodiment the invention is directed to a melt spinning apparatus for making polymeric nanofibers, comprising:

(i) a first surface of a rotating member with one or more discharge points to allow flow of a spinning fluid in the form of fibers or fibrils to exit therefrom;

(ii) a means for directing an ion flow to the spinning fluid, or to the fibers or fibrils or both fibers or fibrils and spinning fluid such that the ion flow deposits a charge on the fibers; and (iii) a collection belt that has a charge opposite to the charge on the fibers in (ii) above.

In a still further embodiment, the invention is directed to a nanoweb comprising one or more regions in which nanofibers are laid down in a pattern with a uniformity index of less than 5.0 or even less than 1.0. In yet another embodiment, the invention is directed to a web having a uniformity index in a range of about 0.1 to about 5 when measured on a sample size of 90 by 60 cm at 3000 by 2000 pixels.

DETAILED DESCRIPTION

Figure 1:
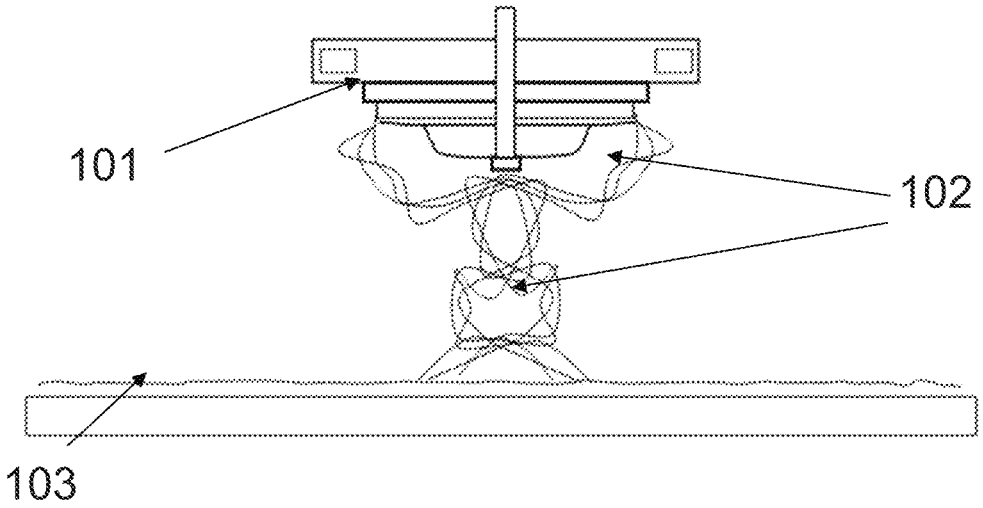
FIG. 1 is an illustration of fiber twisting and swirling under a spin disk.
Figure 1:
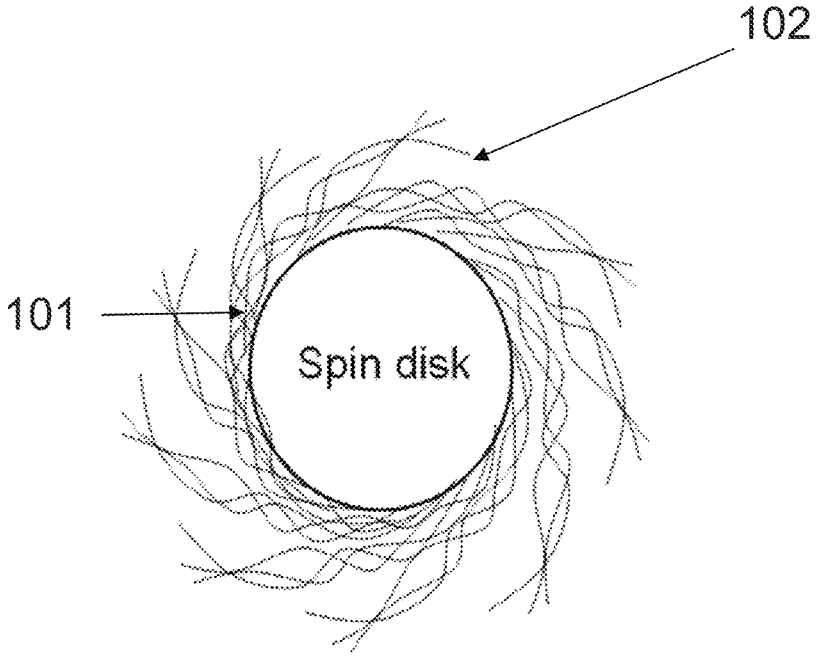

The present invention relates to methods and processes for the dual use of electrostatic charging and air management, in the centrifugal spinning of fibers, to produce uniform fibrous webs or nanowebs.

DEFINITIONS

The term "nonwoven" as used herein refers to a web including a multitude of essentially randomly oriented fibers where no overall repeating structure can be discerned by the naked eye in the arrangement of fibers. The fibers can be bonded to each other, or can be unbonded and entangled to impart strength and integrity to the web. The fibers can be staple fibers or continuous fibers, and can comprise a single material or a mixture of a plurality of materials, either as a mixture of fibers each being made from different materials, or as a group of similar fibers each being made from the same mixture of different materials.

The term "nanoweb" as used herein is synonymous with "nano-fiber web" or "nanofiber web" and refers to a nonwoven web constructed predominantly of nanofibers. "Predominantly" means that greater than 50% of the fibers in the web, by number count or be weight, are nanofibers, where the term "nanofibers" as used herein refers to fibers having a number average diameter less than 1000 nm, even less than 800 nm, even between about 50 nm and 500 nm, and even between about 100 and 400 nm. In the case of non-round cross-sectional nanofibers, the term "diameter" as used herein refers to the greatest dimension of a cross section of the fiber. The nanoweb of the invention can also nave greater than 70%, or 90% or it can even contain 100% of nanofibers.

By "centrifugal spinning process" is meant any process in which fibers are formed by ejection of dissolved or melted polymer from a rotating member.

By "rotating member" is meant a spinning device that propels or distributes, away from itself, a material in the form of fibrous streams from which fibrils or fibers are formed by centrifugal force, whether or not another means such as air is used to aid in such propulsion.

By "fibril" is meant the elongated structure that may be formed as a precursor to fine fibers that form when the fibrils are attenuated. Fibrils are formed as fibrous streams of polymer are ejected at a discharge point of the rotating member. The discharge point may be an edge, as described for example in U.S. Pat. No. 8,277,711, or an orifice through which fluid is extruded to form fibrils and fibers.

By "air flow field" is meant the vector field that describes the speed and direction at any point or physical location in the methods of this invention of the flow of air. The term "air" is used herein to mean air itself or any other inert gas or gaseous fluid, or mixtures of such.

By "charged" is meant that an object in the process has a net electric charge, positive or negative polarity, relative to uncharged objects or those objects with no net electric charge.

By "spinning fluid" is meant a thermoplastic polymer, in either melt or solution form, that is able to flow and be formed into fibers.

By "discharge point" is meant the location on a rotating member from which fibrous streams of polymer are ejected to form fibrils or fibers. The discharge point may, for example, be an edge, or an orifice through which fibrils are extruded.

Methods of Spinning

Considering first. FIG. 1, a spinning process is shown that does not employ the process of the present invention. Fibers (102) are shown exiting a discharge point (101) in side view and plan view of a rotating member. The fibers are deposited on a collector (103). Typically, as illustrated schematically in FIG. 1, fibers do not flow in a controlled fashion towards the collector and do not deposit evenly on the collector. The process of the present invention remedies this situation by applying air and electrostatic charge to fibrils and fibers being formed by ejection of fibrous streams from a rotating member, with the objective of producing a particularly uniform web.

In one embodiment of the methods hereof, the rotating member is a spinning disk, but is not limited to such; and any member that has an edge or an orifice ("discharge point") from which fibrous streams can be discharged to form fibrils and fibers can be used. The process may then comprise the steps of supplying a spinning melt or solution of at least one thermoplastic polymer to an inner spinning surface of a heated rotating distribution disc, cup or other device having a forward surface fiber discharge point. The spinning melt or solution ("spinning fluid") is distributed along the inner spinning surface of such rotating member so as to distribute the spinning melt into a thin film and toward the discharge point. The process may further involve a discharging step wherein continuous separate molten polymer fibrous streams are discharged from the forward surface discharge point, and the fibrous streams or fibrils formed thereby are attenuated (i.e. tapered and/or reduced in thickness or density) by centrifugal force to produce polymeric fibers. In one embodiment, the fibers formed in this manner may have mean fiber diameters of less than about 1,000 nm.

In a further embodiment, the discharged fibrous stream may also be attenuated by an air flow directed with a component radially away from the discharge point.

In yet other embodiments, the rotating member may have holes or orifices through which the polymer melt or solution is discharged; the rotating member can be in the form of a cup, or a flat or angled disk; and/or the fibrils or fibers formed by the rotating member may be attenuated by air, centrifugal force, electrical charge, or a combination thereof.

Methods of Charging

Any high voltage direct current (d.c.), or unipolar radio frequency high voltage, source may be used to supply an electrostatic field as used in the methods of this invention. An electric field is used to supply a charge, for example, to the spinning fluid. Spinning fluid may be charged while on the rotating member, or as it is discharged in the form of fibrous streams, fibrils or fibers, or even after fibers have been formed as a result of attenuation by air or an electrostatic field. The spinning fluid may be charged directly, such as by means of an ion current from a corona discharge produced by a charged entity proximate to the rotating member. One example of such a charged entity would be a ring carrying a current that is concentric with the rotating member and located proximate to the molten polymer or polymer solution, or to the fibrils or fibers as they are formed upon discharge of the fibrous streams.

The spinning fluid, fibrils or fibers may also or alternatively be charged by induction from a charge held on or near the collector.

The current drawn in the charging process is expected to be small (preferably less than 10 mA). The source should have variable voltage settings (e.g. 0 kV to 80 kV), preferably −5 kV to −15 kV for corona ring and +50 to +70 kV for collection plate, and preferably (−) and (+) polarity settings to permit adjustments in establishing the electrostatic field.

The fibers formed by the methods hereof are therefore charged relative to a collector, such that an electric field is present between the fibers and the collector. The collector may be grounded or charged directly, or indirectly, via a charged plate or other entity in its vicinity, for example below it is charged relative to the rotating member.

Fibers as formed by the methods hereof may attain their charge by the application of a charge to the polymer melt or solution, the molten or solution fibrils (i.e. fibrous streams), the fibers as formed, or any combination of these three locations.

The fibers formed herein may be charged directly, such as by means of a corona discharge and resulting ion current caused by a charged entity proximate to the fibers. One example of such a charged entity would be a ring concentric with the rotating member and located proximate to the molten polymer or polymer solution, or to the fibrils or fibers as they are formed upon discharge of fibrous streams form the rotating member.

In various embodiments, a charge is applied to the collector only and the polymer is a polar polymer.

Figure 2:
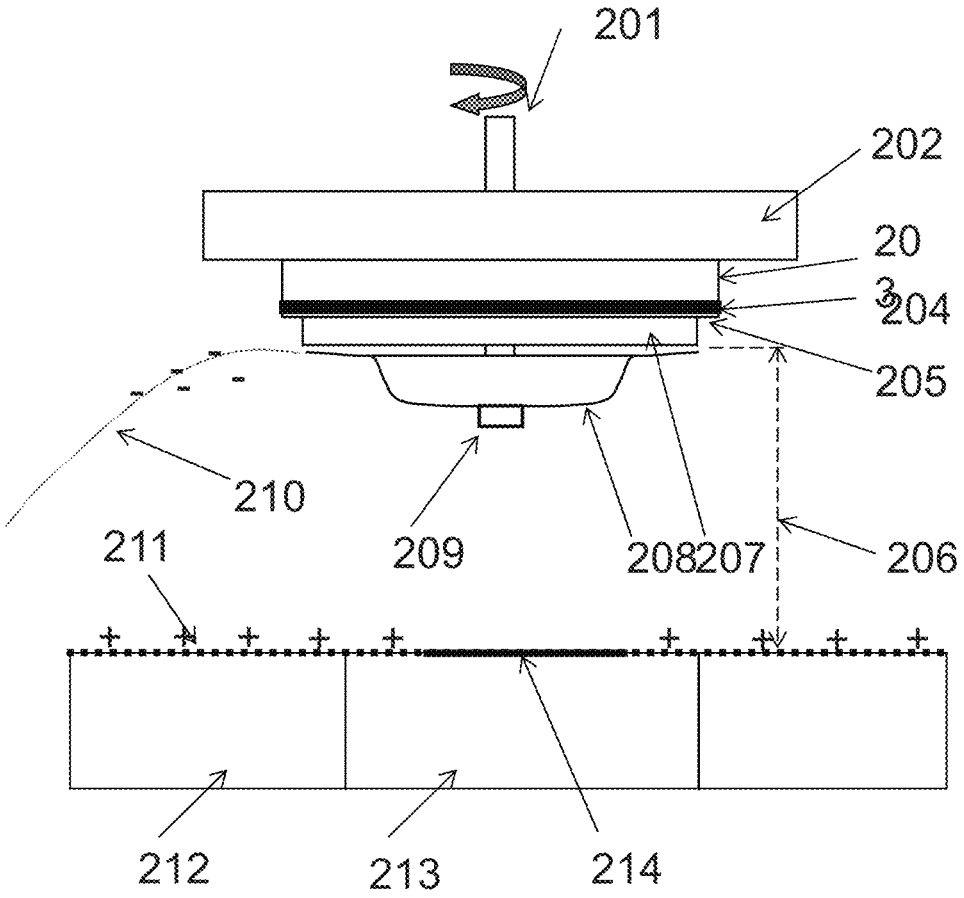
FIG. 2 is a cut-away cross-sectional view of a centrifugal fiber spinning apparatus suitable for use in laying fibrous web according to the present invention.

FIG. 2 schematically illustrates an apparatus that can be used to practice an embodiment of the invention. A spin pack comprises a rotating hollow shaft 201 for driving a spin disk 208. A spin disk air heat chamber 207 is mounted above the spin disk. A fiber stretching zone air heating ring 203 with a perforate air exit plate 205 is assembled around the spin disk air heating chamber 207. A shaping air ring 202 is mounted above the stretching one air ring and passes air vertically downwards in the orientation of FIG. 2 in order to direct fiber towards the collector 211. A charged ring with needle assembly 204 is placed inside of stretching zone air heating ring 203 in order to charge the fiber stream 210. An air hub 209 is mounted below the spin disk 208 on the rotating shaft 201. A desired fiber stream 210 of umbrella shape carrying electric charge is formed by the air flow field from the combination of the air from the gap of spin disk and its heater, the stretching zone air, the shaping air and the air flow from the rotating air hub.

A vacuum box web laydown collector 212 may be placed under the whole spin pack. The spin pack to collector distance may be in a range of 10 cm to 15 cm. The collector may have a perforated surface. In the embodiment of FIG. 2, there is a solid circle plate 213 having a diameter of slightly larger than the spin disk at the center of collector. There is a no charging zone 214 with a diameter about the air hub. Vacuum can be applied to the collector with the higher strength at the corners and the edges of the collector, and gradually reducing to zero when toward to the center of the collector. In various embodiments, therefore, vacuum can be applied in the shape of an annulus or ring such that there is no vacuum in the middle of the area of the collector.

Figure 3:
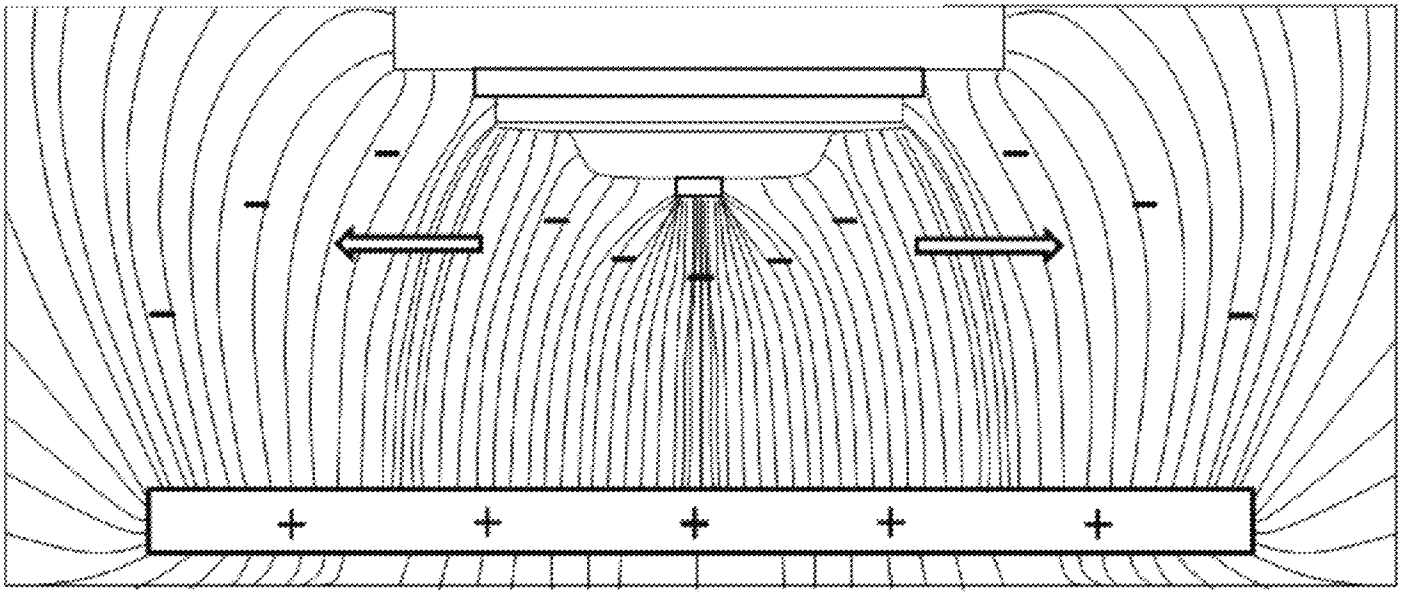
FIG. 3 is an illustration of the electrical field within the fiber spinning and web formation area of the apparatus of the present invention.

FIG. 3 illustrates the electric field pattern that can be used to implement the methods of the invention and that is obtained with the implementation of the methods and apparatus as shown in FIG. 2. With the present configuration of the combination of both dual charging and air management, the fiber stream will be formed in an umbrella shape, as shown as in FIG. 3, and lay down as a uniform web.

Figure 4:
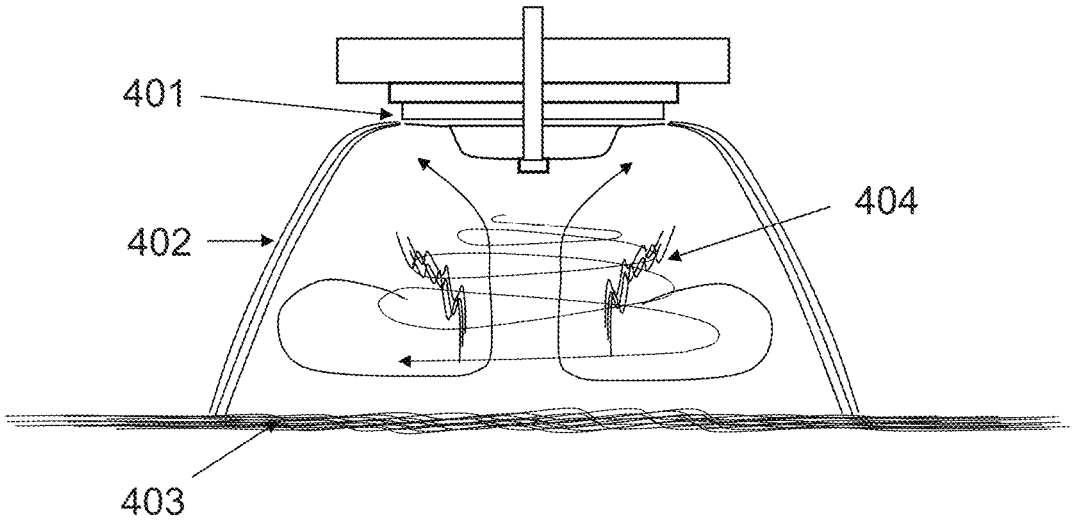
FIG. 4 is a cut-away side view of an illustration of the fiber pattern with charging but without the element of air management according to the present invention.

FIG. 4 is a schematic cut-away side view of an illustration of the fiber pattern with charging but without the element of air management according to the present invention. Fiber (402) is expelled form a discharge point (401) towards a collector (403). The lack of air management, however, results in turbulence (404) beneath the spin disk, and a web of inferior uniformity.

Method of Applying Air

The air flow field has two regions in which the direction and rate of air flow are characterized. The first region is at the point of discharge of fibrous streams from the rotating member to form fibrils or fibers. The direction of air flow in this first region is essentially perpendicular to the spinning axis of the rotating member. The direction of air flow is essentially perpendicular to the spinning axis if it is actually true perpendicular, or if it varies from true perpendicular by less than 20%, or less than 15%, or less than 10%, or less than 5%, or less than 1%.

The air flow may be along the radial direction of the rotating member or it may be at an angle to it. The air may supplied from a plurality of nozzles located proximate to the rotating member, or it may be supplied from a slot, or otherwise in a continuous fashion around the edge of the rotating member. The air may be directed radially outwards from the spinning axis, or it may be directed at an angle to the radius at the point where the air leaves any particular nozzle.

In one embodiment, the air may therefore be supplied from a nozzle that has an opening that is located on a radius of the rotating member, and the air flow may be directed at an angle to the radius of between 0 and 60 degrees and in a direction opposite to the direction of rotation of the rotating member.

The second region of the air flow field is in the space proximate to the collector but that is distal from the periphery of the rotating member. In this region, the air flow is essentially perpendicular to the collector surface. The air therefore directs the fibers onto the surface of the collector where they are held in position by the electrostatic charge on the fibers and the electric field between the collector and the rotating member.

Air in this region may be supplied by nozzles located on the underside of the rotating member, on the surface thereof facing the collector. The nozzles may be directed towards the collector.

The air flow field may further include a flow of air into the collector that is essentially perpendicular to the collector from a region between the body of the rotating member and the collector surface.

Figure 5:
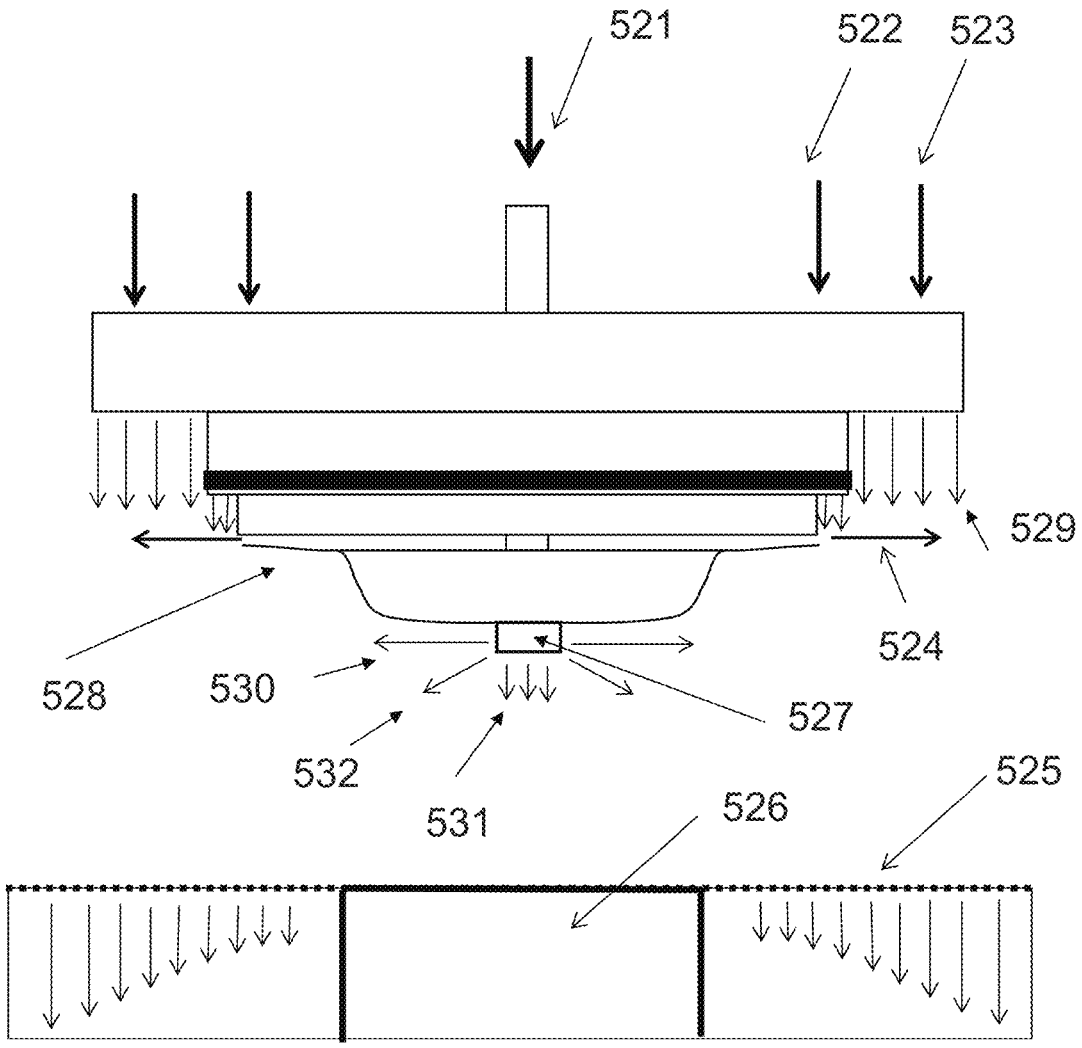
FIG. 5 is a cut-away side view of an illustration of centrifugal fiber spinning apparatus with air management suitable for use in laying fibrous web according to the present invention.

In FIG. 5 is shown an embodiment of an apparatus that implements the air management element of the methods of the present invention. Fibrous streams (524) are ejected from the rim of a spinning disk, 528, to form fibers. The apparatus is provided with air flow inlets 521, 522 and 523. Air (529) is ejected through outlets fed from 522 and 523 in such a way as to direct the formed fiber towards a collector 525. A vacuum may also be applied under at least a portion of the collector to dram air through the collector surface. The collector may have a dead zone (526) through which no air flows.

Air may also supplied to the fibers through a cup or hub (527) located underneath the spin disk and supplied from air inlet 521. As seen schematically in FIG. 5, air may flow parallel (530) to or perpendicular (531) to or at an intermediate angle to (532) the direction of election of formed fibers from the discharge point. In various embodiments hereof, fibrous streams in the form of fibrils or fibers of molten polymer or polymer solution are discharged from a rotating member into an air flow field that is essentially parallel to the direction of discharge of fibrils at the point of discharge of the fibrils. The direction of air flow is essentially parallel to the direction of discharge of fibrils if it is actually true parallel, or if it varies from true parallel by less than 20%, or less than 15%, or less than 10%, or less than 5%, or less than 1%. In various other embodiments hereof, air is discharged, from one or more air discharge ports, in a direction that is essentially parallel to axis on which the rotating member rotates. The direction of air flow is essentially parallel to the rotating member axis if it is actually true parallel, or if it varies from true parallel by less than 20%, or less than 15%, or less than 10%, or less than 5%, or less than 1%.

Figure 6:
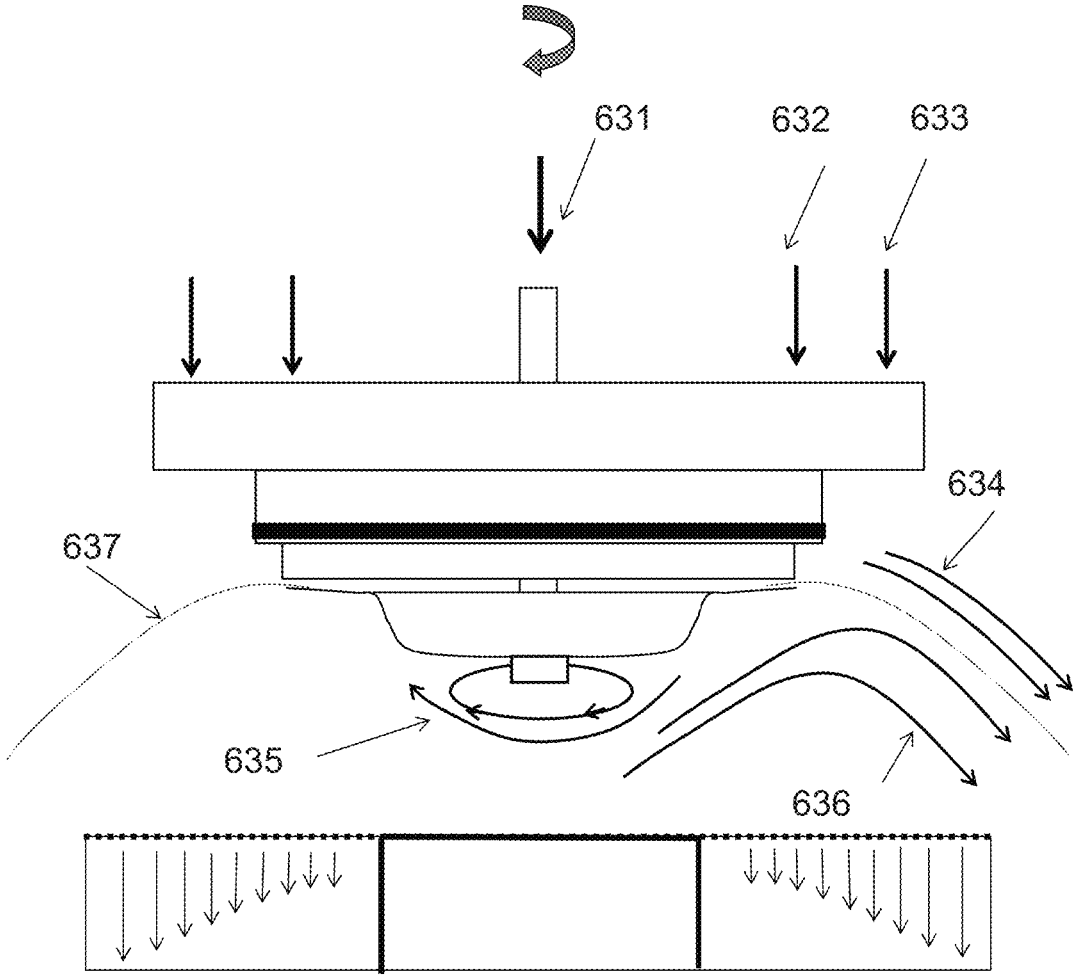
FIG. 6 is a cut-away side view of an illustration of a centrifugal fiber spinning apparatus and air flow field with air management with the spin disk and anti-swirling hub rotating for use in laving fibrous web according to the present invention.

FIG. 6 is an illustration of the air flow field that may be obtained by use of the apparatus shown in FIG. 5. Air inlets 631, 632 and 633 generate an air flow field represented by 634, 635 and 637 that carry fiber stream 637 towards a collector. The turbulent behavior shown in FIG. 4 is suppressed.

Figure 7:
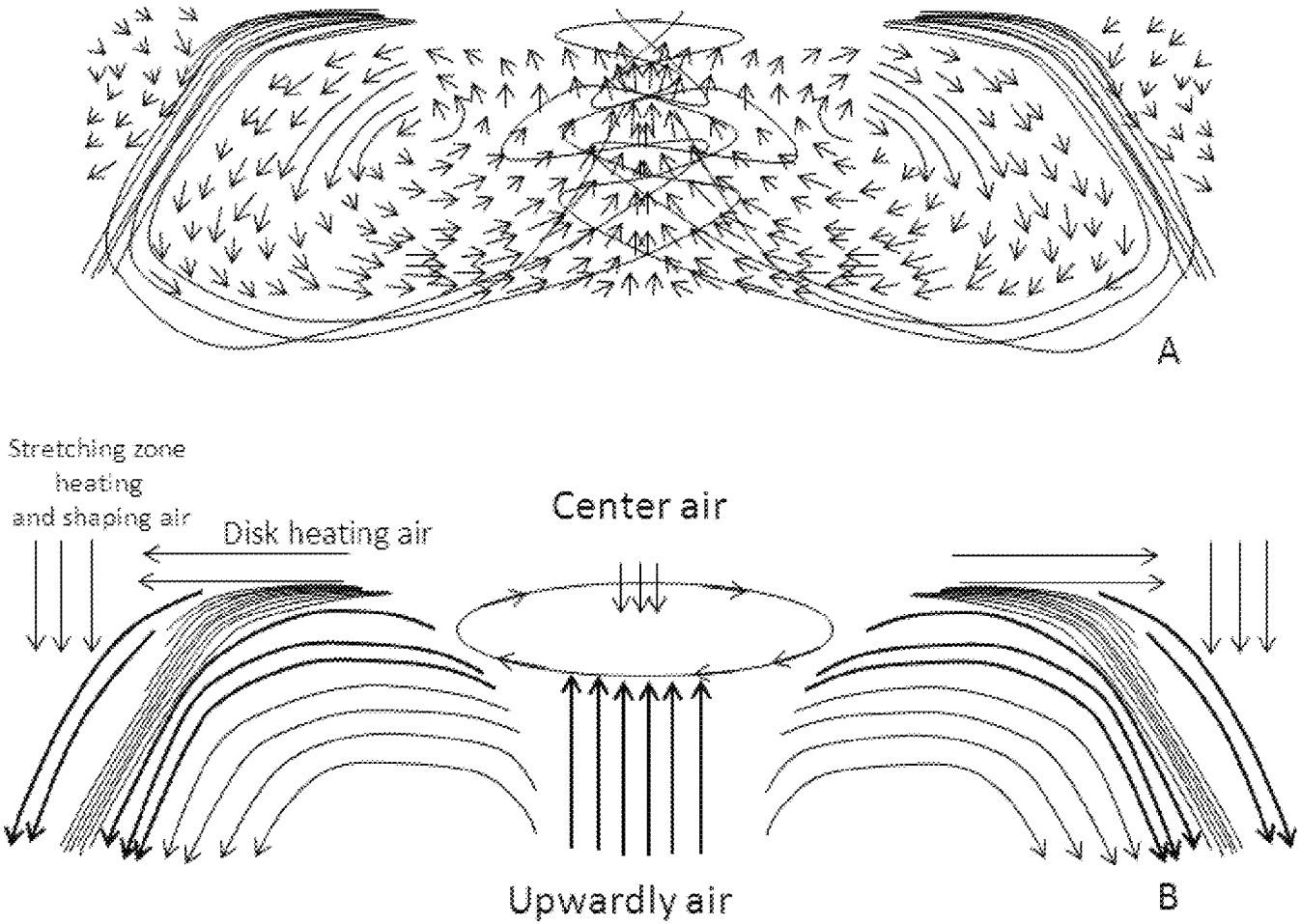
FIG. 7A is an illustration of the air flow field and fiber swirling pattern without air management.
FIG. 7B is an illustration of the of the air flow field and fiber umbrella stream with air management and charging suitable for use in laying fibrous web according to the present invention.

FIGS. 7A and 7B show schematically a comparison between the air flow field that is obtained with and without the air flow management of the present invention in the absence of air management, and in particular with no hub (which is shown at 527 in FIG. 5), air tends to swirl under the spin disc and introduce instability in the lay down of the fiber. With center air directed from a hub, swirling is no longer evident.

Figure 8:
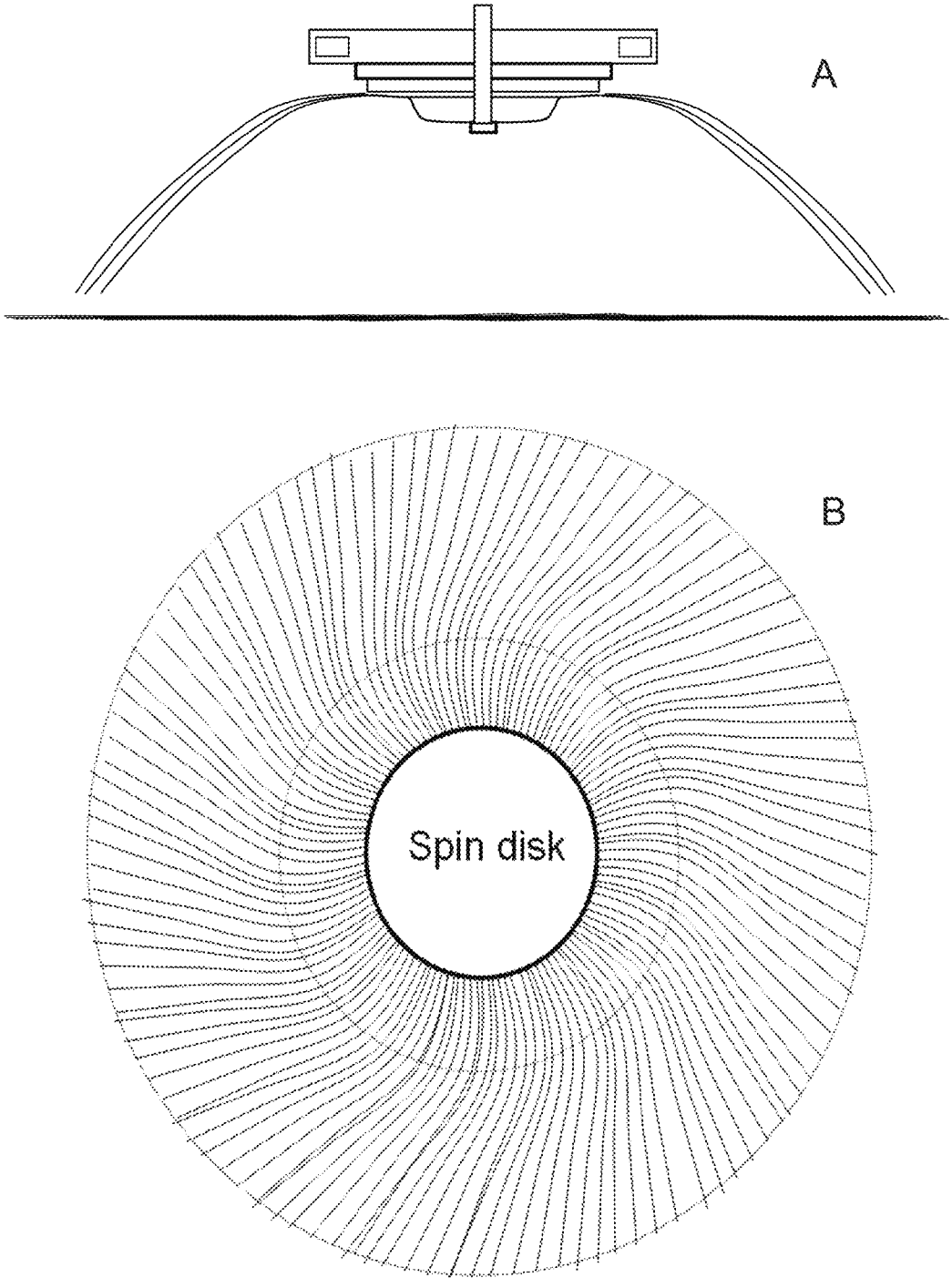
FIG. 8A is an illustration of a cut-away side view of the fiber umbrella stream pattern and FIG. 8B is an illustration of a top view of the fiber umbrella stream pattern with air management and charging suitable for use in laying fibrous web according to the present invention.

The desired fiber flow pattern as fiber is formed upon election of fibrous streams form the discharge point is an umbrella with even fiber distribution at the disk edge and extending down onto the collector. This pattern is illustrated schematically in side view and plan view in FIGS. 8A and 8B.

Fiber Laydown

Multiple spin heads may be used to produce a fibrous web of the invention. A laying web arrangement is obtained from fiber umbrella streams from multiple spin heads while the web laydown surface is moving, as for example on a conveyor belt.

For laying web on scrim, an unwinder and winder are placed on either sides of a web laydown collector. For laving stand-alone scrimless web, a moving circle belt surrounds the web laydown collector, and the top of the belt is contacted to the top surface of the web laydown collector. The web is laid down starting on a short leading scrim onto a winder, then laid down on the surface of the belt for continuous web laydown and winding up to winder to form a stand-alone web roll goods.

Figure 9:
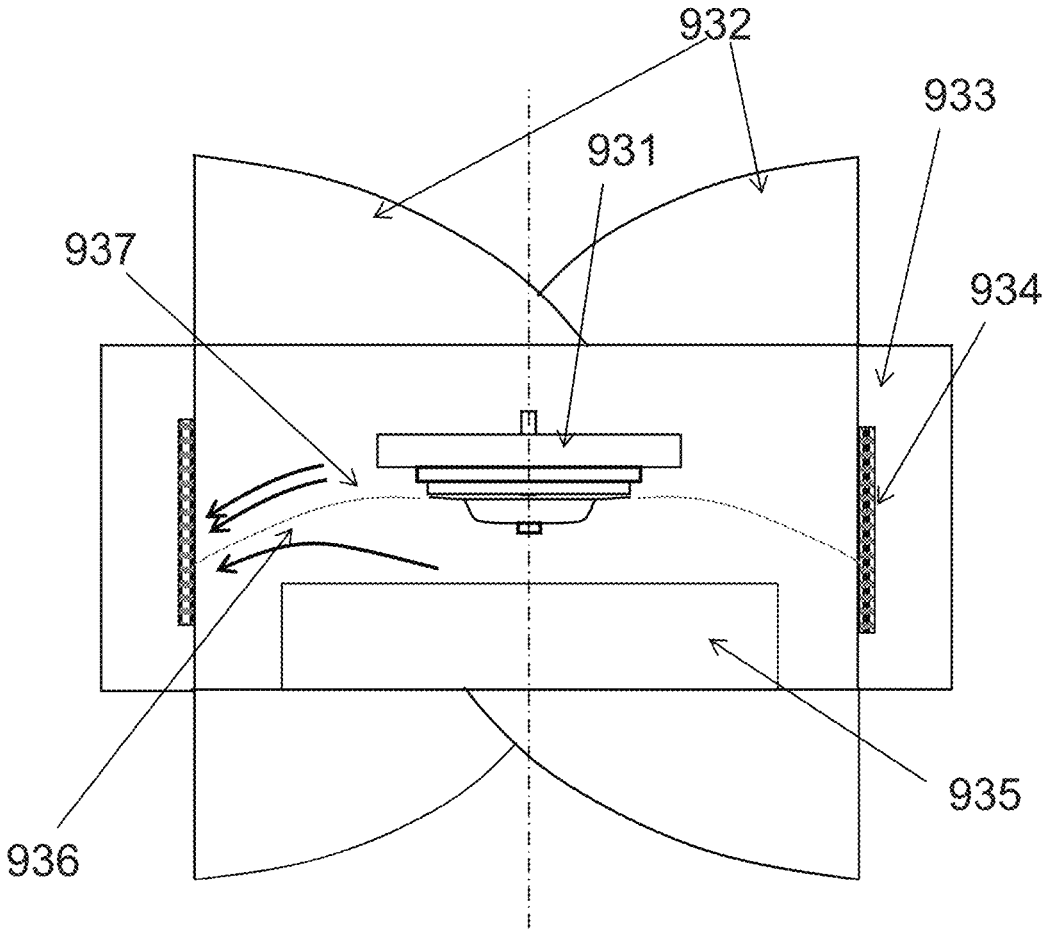
FIG. 9 is an illustration of a cut-away side view of laying web in a cylindrical configuration while the web laydown surface is moving upward or downward.

As another web laydown arrangement, FIG. 9 is an illustration of a cut-away side view of laying web in a cylindrical configuration while the web laydown surface is moving upward or downward. A spin pack 931 is placed in the center of a cylindrical vacuum collector 933 with charging surface 94. An air flow field represented by 935 carries fiber stream 937 towards to the cylindrical inner surface of the collector. A pair of forming horns 932 is used for converting flat belt to cylindrical shape when moving into the collector, and for converting the cylindrical shape to flat belt when moving out from the collector.

Fibers may be spun from any of the thermoplastic resins capable of use in centrifugal fiber or nanofiber spinning. These include polar polymers such as polyesters, polyethylene terephthalate (PET), polybutylene terephthalate (PET), and polytrimethyl terephthalate (PTT), and nylon (polyamide); suitable non-polar polymers include polypropylene (PP), polybutylene (PB) polyethylene (PE), poly-4-methylpentene (PMP), and their copolymers (including EVA copolymer), polystyrenepolymethylmethacrylate (PMMA), polytrifluorochloroethylene, polyurethanes, polycarbonates, silicones, and blends of these. With charging agents in non-polar polymers, the methods hereof will work better.

In various other embodiments, the methods hereof further include a step of fabricating an article from a nonwoven web as obtained herein. Fabrication steps can include cutting and stitching the non-woven web, and/or combining the non-woven web with other layers, such as fabrics or films, to form a multi-layer laminate or other structure. An article fabricated from a non-woven web as obtained herein can include a filter, a membrane in a fuel cell, or a separator for use to separate the electrodes in an electrolyte solution in a battery.

Apparatus

The invention is further directed to an apparatus for laying down a web from a centrifugal spinning process. A melt spinning apparatus for making polymeric fibers, as disclosed herein, includes:

- a rotating member that rotates about an axis with an edge or orifices to allow flow of polymer melt or solution fibrils to exit therefrom;
- a means for directing an ion flow to the polymer melt or solution, or to the fibrils or both such that the ion flow generates a charge on the fibers;
- a collection belt that has a charge opposite to the charge on the fibers in (ii) above;
- nozzles located on the underside of the rotating member, on the surface facing the collector. The nozzles may be directed towards the collector;
- a nozzle that has an opening that is located on a radius of the rotating member, and the air flow is directed at an angle to the radius of between 0 and 60 degrees and in a direction opposite to the direction of rotation of the rotating member.

A plurality of nozzles may be located proximate to the rotating member, and may be directed radially outwards from the spinning axis, or it may be directed at an angle to the radius at the point where the air leaves any given nozzle.

Web Structure

The inventions hereof are further directed to a web with an exceptionally high uniformity index (UT) as defined herein. In a preferred embodiment, the web is a nanoweb. The possible levels of uniformity that can be achieved using the process of the invention will are explained below with reference to certain non limiting examples.

In various other embodiments, the inventions hereof include a method for laying down a web of fibers that includes the steps of (a) rotating a rotating member (i) to apply centrifugal force to a molten polymer or polymer solution contained within the rotating member, and (ii) to discharge from the rotating member fibrous streams of the molten polymer or polymer solution; (b) applying an air flow field that is essentially parallel to the fibrous streams to attenuate the fibrous streams and form fibrils and/or fibers therefrom; and (c) applying to the fibrils and/or fibers an air flow field and an electrical charge to direct them to the surface of a web collector.

In various other embodiments, the inventions hereof include a spinning apparatus for making a web of polymeric fibers, that includes (a) a rotating member that rotates on an axis and having one or more discharge points to discharge therefrom fibrous streams of molten polymer or a polymer solution; (b) one or more air discharge ports to discharge air in a direction that is essentially parallel to the direction of discharge of the fibrous streams, or is essentially parallel to the axis of the rotating member, and/or is essentially perpendicular to the axis of the rotating member; (c) a voltage source to apply an electrical charge to fibrils or fibers formed from the fibrous streams; and (d) a collection surface to collect fibers and from a web therefrom wherein the collection surface has an electrical charge that is opposite in polarity to the charge on the fibrils or fibers.

EXAMPLES

The operation and effects of certain embodiments of the inventions hereof may be more fully appreciated from a series of examples, as described, below. The embodiments on which these examples are based are representative only, and the selection of those embodiments to illustrate the invention does not indicate that materials, components, configurations, designs, conditions and/or techniques not described in the examples are not suitable for use herein, or that subject matter not described in the examples is excluded from the scope of the appended claims and equivalents thereof.

Measurement of Uniformity Index.

A web sample was placed on a lighting box providing uniform transmitted light, from a lighting plate using arrays of LED's. A digital camera was used for taking images from different sizes of samples with desired megapixel numbers.

The calculation of uniformity index comprises the following steps:

(i) The pixel field is first divided into a series of 2×2 pixel blocks. This division is defined as layer 1.

Figure 10:
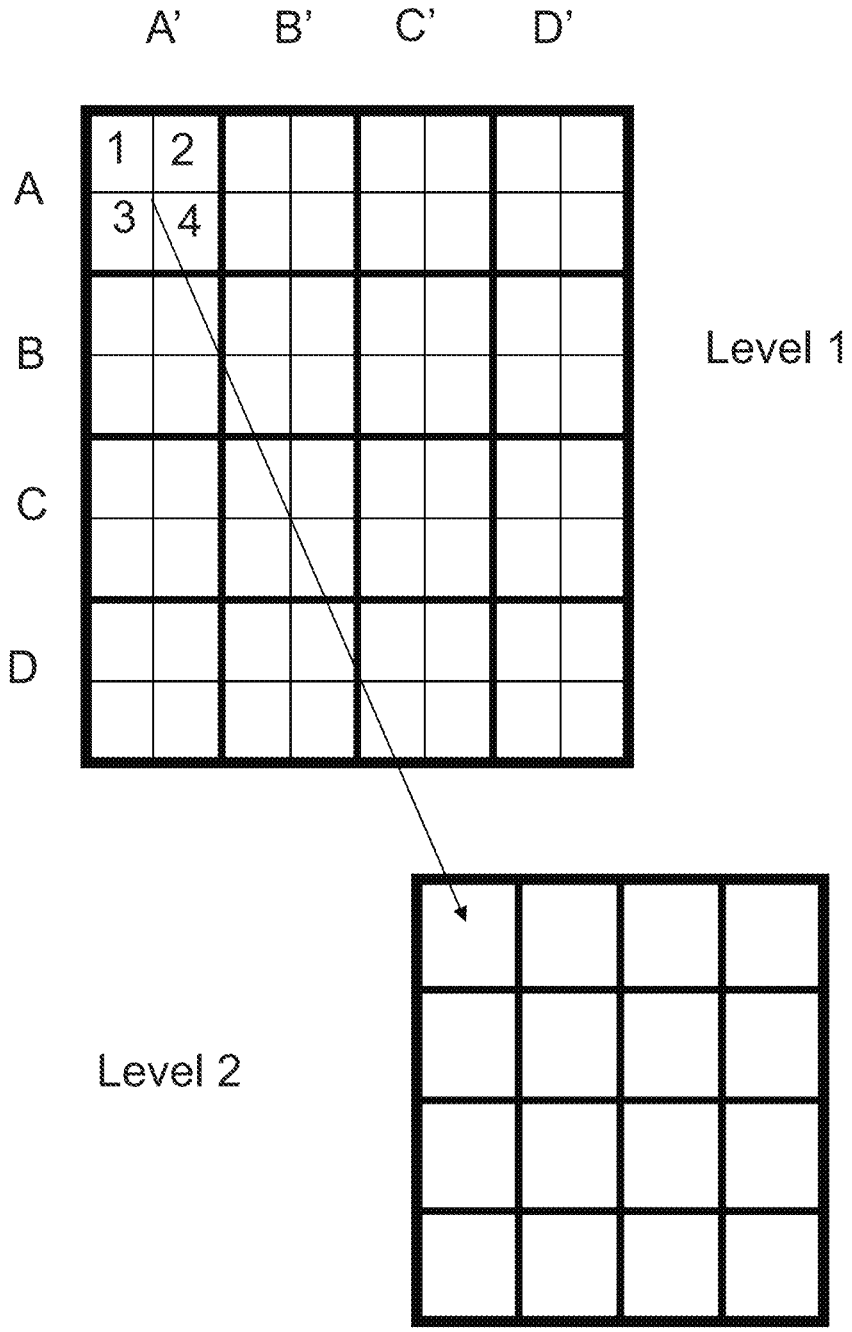
FIG. 10 and FIG. 11 are illustrations used in the web uniformity calculation in the present invention.

(ii) Referring now to FIG. 10 for layer 1, the percent difference ("PD") value for block AA' is calculated from:

$$PD(A,A')=100\Sigma Abs(L_i-L_j)/(6\times 256)$$

where $L_i$ is the luminosity value for pixel i and the summation is over i<j for j=1 to 4 so there are 6 terms in the sum and the luminosity has a scale range of 256.

(iii) The absolute luminosity ("AL") for block AA' is calculated from:

$$AL(A,A')=\Sigma L_i/4$$

where the sum is over i=1 to 4.

(iv) The PD and AL values are calculated for all of the 2×2 blocks in level 1, and the UT value for the layer 1 is then calculated from:

$$UI_1=[SD \text{ of all of the blocks' } PD(m,n)]\times[\text{average of all the blocks' } PD(m,n)]\times[SD \text{ of all of the blocks' } AL(m,n)]$$

where SD refers to standard deviation.

Figure 11:
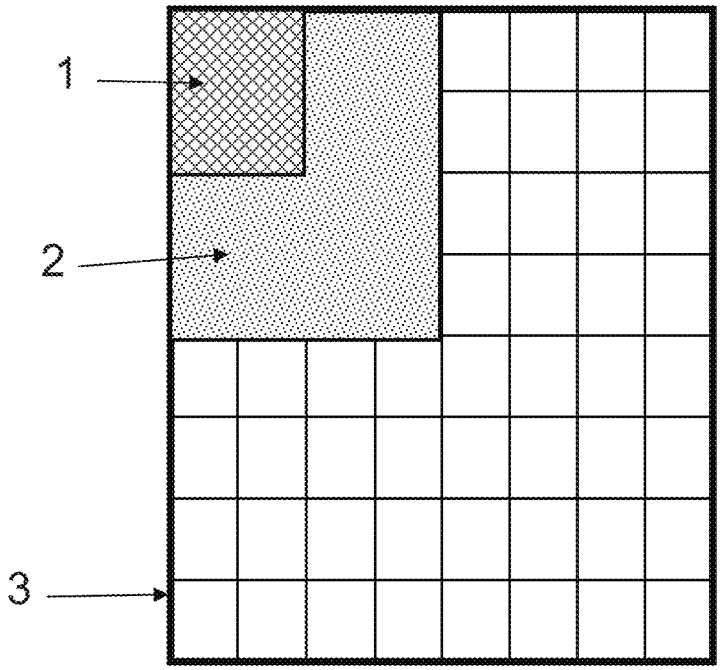

FIG. 10 shows how the block AA' in level 1 now becomes an element of a single block in level 2. The process steps above are then repeated for layers 2 up to the largest layer number that the image can support where the layer definitions are seen in FIG. 11. For example, layer 1 consists of blocks that consist of the 2×2 pixel squares. Layer 2 consists of four blocks (2×2) where each block consists not of pixel squares but the 2×2 pixel blocks from layer 1. Layer 3 consists of the four blocks where each block consists of the 4×4 pixel blocks from layer 2, and so on until the image cannot accommodate any more levels.

The uniformity index (UI) is then defined as the average UI over all of the layers in the image, i.e.

$$UI=\Sigma UI_i/N$$

where the sum is over level numbers and N is the total number of layers in the image.

A lower uniformity index (UI) indicates a more uniform distribution of fibers.

Hereinafter the inventions hereof will be described in more detail in the following examples. The web images in the following examples were taken and measured on a sample size of 90 by 60 cm at 3000 by 2000 pixels.

Example 1

No Electrostatic Field

Continuous fibers were made using an apparatus as illustrated in FIG. 2, from a low molecular weight (Mw) polypropylene (PP) homopolymer, Metocene MF650Y from LyondellBasell. It is of Mw=75,381 g/mol, and melt flow rate=1800 g/10 min (230° C./2.16 kg). A PRISM extruder with a gear pump was used to deliver the polymer melt to the rotating spin disk through the supply tube. The temperature of the spinning melt from the melt supply tube was set to 240° C. The disk heating air was set at 860° C. The stretching zone heating air was set at 150° C. me shaping air was set at 30° C. The rotation speed of the spin disk was set to a constant 10,000 rpm. There was no center air through the hollow rotating shaft and no anti-swirling hub used. There was no upward air flow at the center from web collector under the spin disk. No electrical field or ion charging was used during this test.

Figure 12:
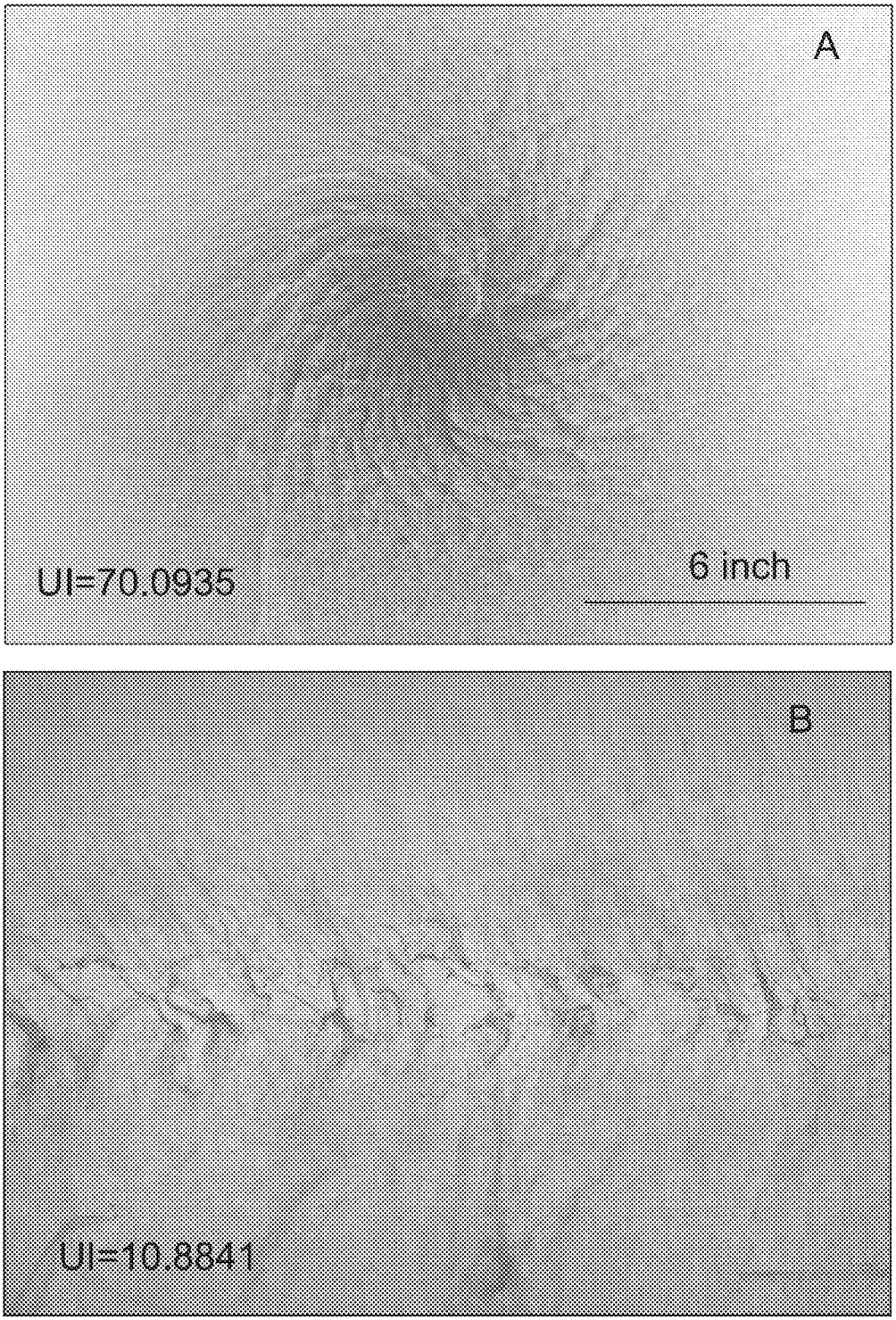
FIG. 12A shows the web image of a stationery laydown of a polypropylene fiber without a moving belt.
FIG. 12B shows the same laydown with a moving belt.

Nanofiber web was layed down on a belt collector with a laydown distance of 15 cm. The fiber size was measured from an image using scanning electron microscopy (SEM) and the fibers were determined to have an average fiber diameter of about mean=430 nm and median=381 nm. FIG. 12 (A) shows the web image of a stationery laydown without a moving belt. A fiber swirling pattern appeared in the center of the web under the spin disk. The web uniformity index was UI=70.0935. Under the same condition, FIG. 12 (B) shows the web image of a web laydown with the belt moving at 22.5 cm/min. A fiber swirling pattern appeared along the center region of the web. The web uniformity index was UI=10.8841.

Example 2

Figure 13:
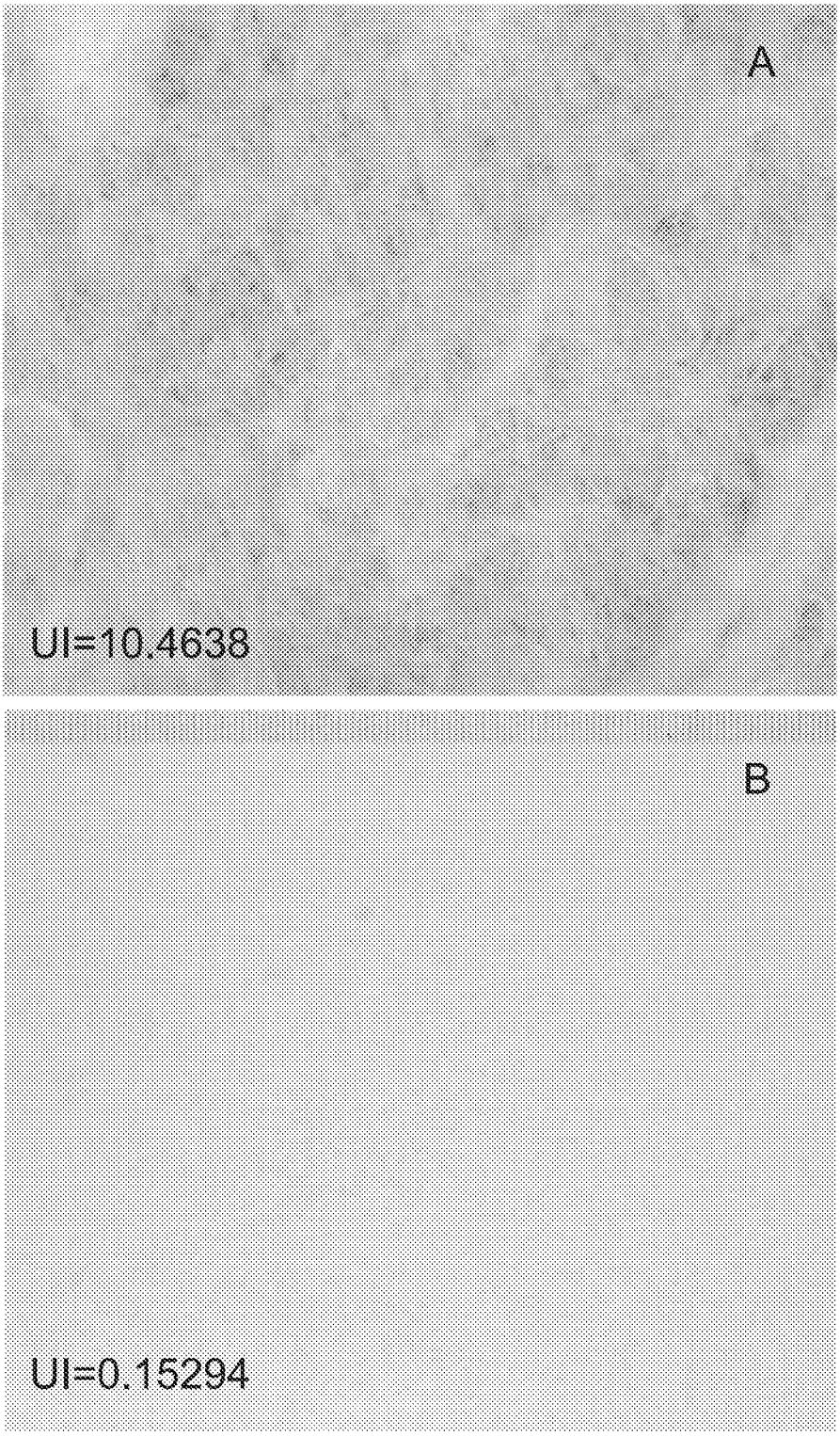
FIG. 13A shows an example of a laydown on a belt collector with a laydown distance of 90 cm without electrical field and air management.
FIG. 13B shows the same laydown with a laydown distance of 15 cm and with electrical field and air management applied.

With the same spinning conditions as in Example 1, a nanofiber web shown in FIG. 13 (A) was laid on a belt collector with a laydown distance of 90 cm with no electrical field, or electric charge. The belt speed was 22.5 cm/min. FIG. 13 shows the resulting web. The web uniformity index was UI=10.4638.

FIG. 13 (B) shows the web image of a web with a laydown distance of 15 cm and with electrostatic charging under the same spinning conditions. Center air was applied through the hollow rotating shaft and an anti-swirling hub (527 in FIG. 5) was used. The web uniformity index was UI=0.15294.

Example 3

Continuous fibers were made using an apparatus as illustrated in FIG. 2, from a polypropylene (PP) 50%/50% blend of a high Mw PP and a low Mw PP. The high Mw PP was Marlex HGX-350 from Phillips Sumika. It had Mw=292,079 g/mol, and melt flow rate=35 g/10 ruin (230° C./2.16 kg). The low Mw PP is Metocene MF650Y used in Example 1 from LyondellBasell. It was of Mw=75,381 g/mol, and melt flow rate=1800 g/10 min (230° C./2.16 kg).

A PRISM extruder with a gear pump was used to deliver the polymer melt to the rotating spin disk through the supply tube. The temperature of the spinning melt from the melt supply tube was set to 260° C. The gear pump speed was set to a melt feed rate of about 5 g/min. with the pressure at a constant 12 psi. The disk heating air was set at 280° C. The stretching zone heating air was set at 180° C. The shaping air was set at 30° C. and 15 SCFM. The rotation speed of the spin disk was set to a constant 10,000 rpm. The speed of the belt was 22.5 cm/min.

A nanofiber web was laid down on a belt collector with a laydown distance of 14 cm. The fiber size was measured from an image using scanning electron microscopy (bind) and the fibers were determined to have an average fiber diameter of about mean=640 nm and median=481 nm.

Figure 14:
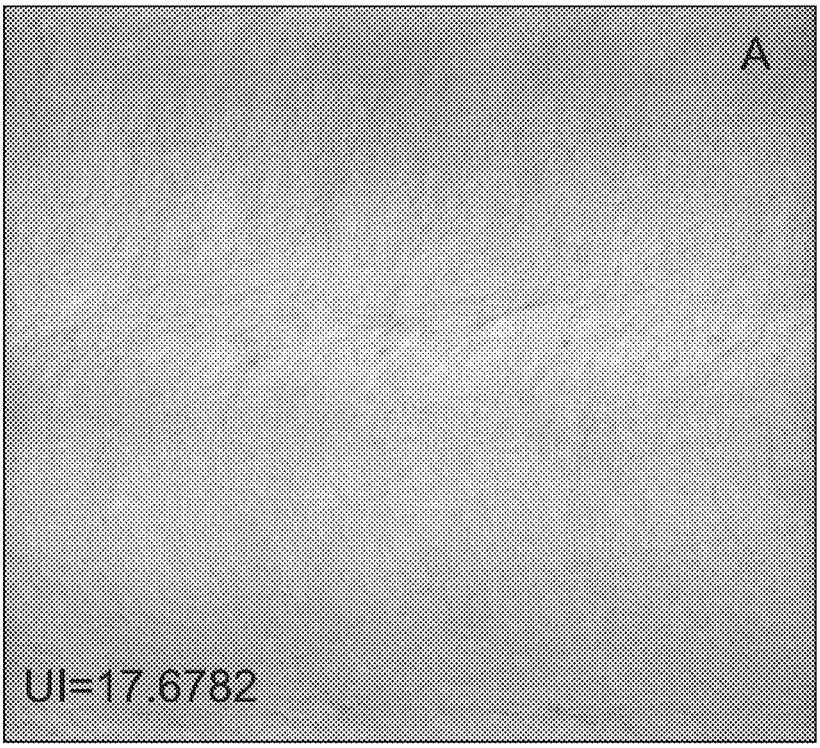
FIG. 14 shows examples of laydown of polypropylene webs with and without air.
Figure 14:
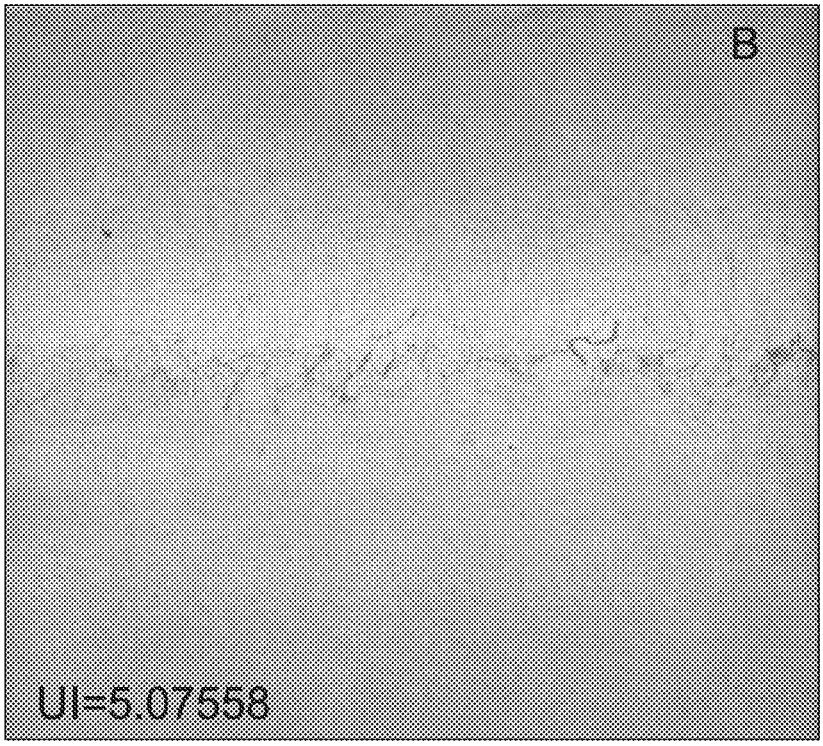

The center air through the rotating shaft to hub was set at 30° C., and, without charging, FIG. 14 (A) shows the web image of web uniformity index UI=17.6782. Fiber bundles appeared in the web.

Figure 15:
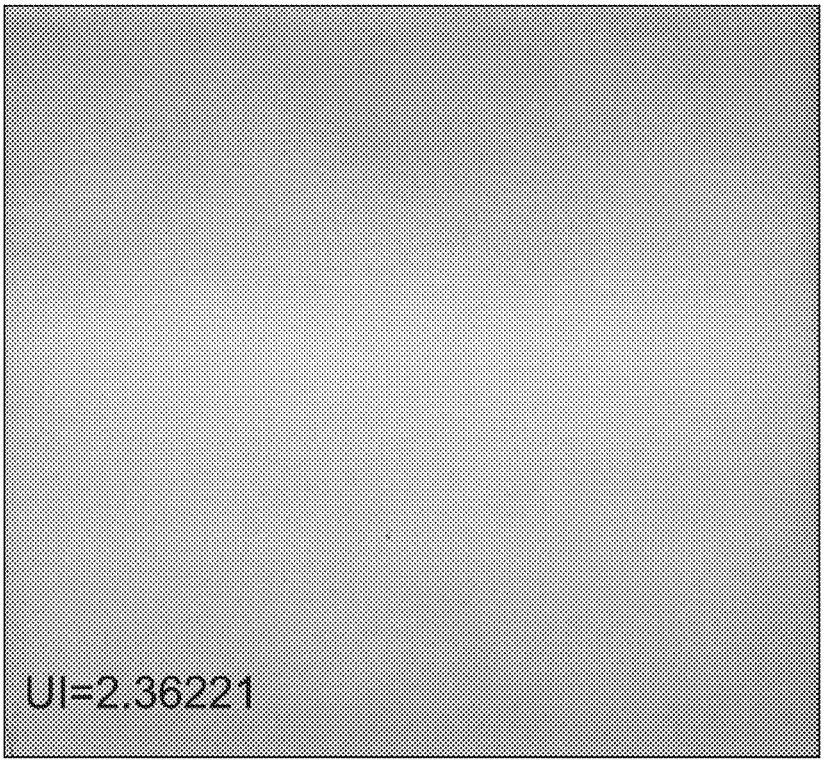
FIG. 15 shows an example of laydown of a polypropylene web with air and with electrostatic field.

With dual high voltage charging of +50 kV and 0.6 mA on collector belt, −12 kV and 0.6 mA on corona ring, without air management, FIG. 14 (B) shows that the web uniformity index is UI=5.07558. There was a stripe of a fiber swirling pattern still appearing in the center of the web under the spin disk. With dual charging and air management, FIG. 15 shows that the web uniformity index is UI=2.36221.

Example 4

Continuous fibers were made using an apparatus as illustrated in FIG. 1, from a polyethylene terephthalate (PET) homopolymer, PET F61, from Eastman Chemical. A PRISM extruder with a gear pump was used to deliver the polymer melt to the rotating spin disk through the supply tube. The temperature of the spinning melt from the melt supply tube was set to 260° C. The gear pump speed was set to a melt feed rate of about 5 g/min with the pressure at a constant 12 psi. The disk heating air was set at 280° C. The stretching zone heating air was set at 180° C. The shaping air was set at 30° C. The rotation speed of the spin disk was set to a constant 10,000 rpm. The laydown be was moving at 22.5 cm/min.

A nanofiber web was laid down on a belt collector with a laydown distance of 14 cm. The fiber size was measured from an image using scanning electron microscopy (SEM) and the fibers were determined to have an average fiber diameter of about mean=730 nm and median=581 nm.

Figure 16:
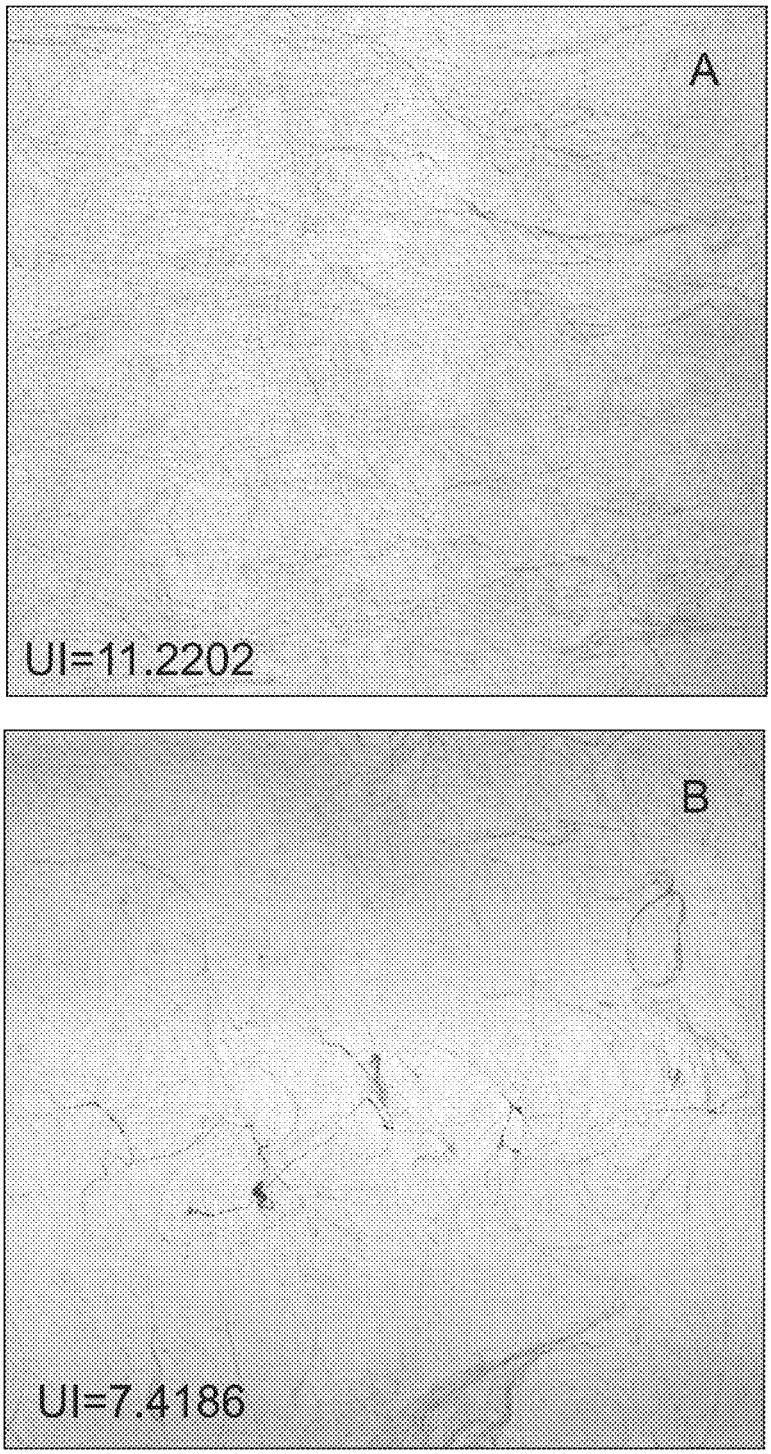
FIG. 16 shows examples of laydown of polyethylene terephthalate webs with and without air.

The center air through the rotating shaft was set at 30° C., with center upward air flow, and, without charging implemented. FIG. 16 (A) shows the web image with web uniformity index is UI=11.2202. Fiber bundles appeared in the web.

Figure 17:
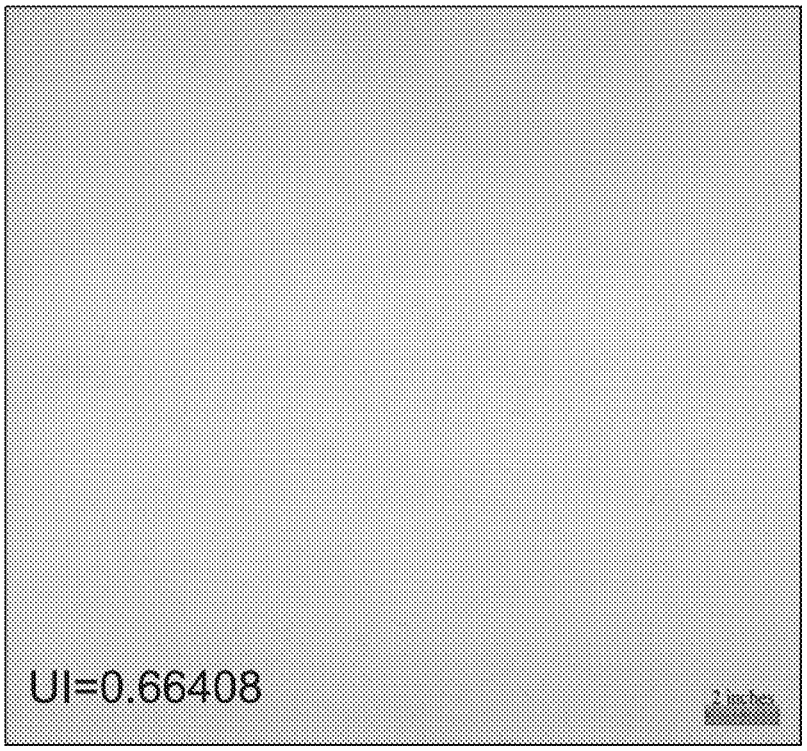
FIG. 17 shows an example of laydown of a polyethylene terephthalate web with air and with electrostatic field.

With dual high voltage charging of 4-50 kV and 0.6 mA on collector belt, −12 kV and 0.6 mA on the corona ring, and without air management, FIG. 16 (E) shows that the web uniformity index is UI=7.4186. There was a stripe of fiber swirling pattern in the center of the web under the spin disk. With dual charging and air management, FIG. 17 shows that the web uniformity index is UI=0.66408.

Example 5

Continuous fibers were made using an apparatus as illustrated in FIG. 1, from a polybutylene (PB) homopolymer, PB 0801M, from LyondellBasell. A. PRISM extruder with a gear pump was used to deliver the polymer melt to the rotating spin disk through the supply tube. The temperature of the spinning melt from the melt supply tube was set to 210° C. The gear pump speed was set to a melt feed rate of about 5 g/min with the pressure at a constant 12 psi. The disk heating air was set at 240° C. The stretching zone heating air was set at 110° C. The shaping air was set at 30° C. The rotation speed of the spin disk was set to a constant 10,000 rpm. The laydown belt was moving at a speed of 22.5 cm/min.

Nanofiber web was laid down on a belt collector with a laydown distance of 14 cm. The fiber size was measured from an image using scanning electron microscopy (SEM) and the fibers were determined to have an average fiber diameter of 530 nm and median of 481 nm.

Figure 18:
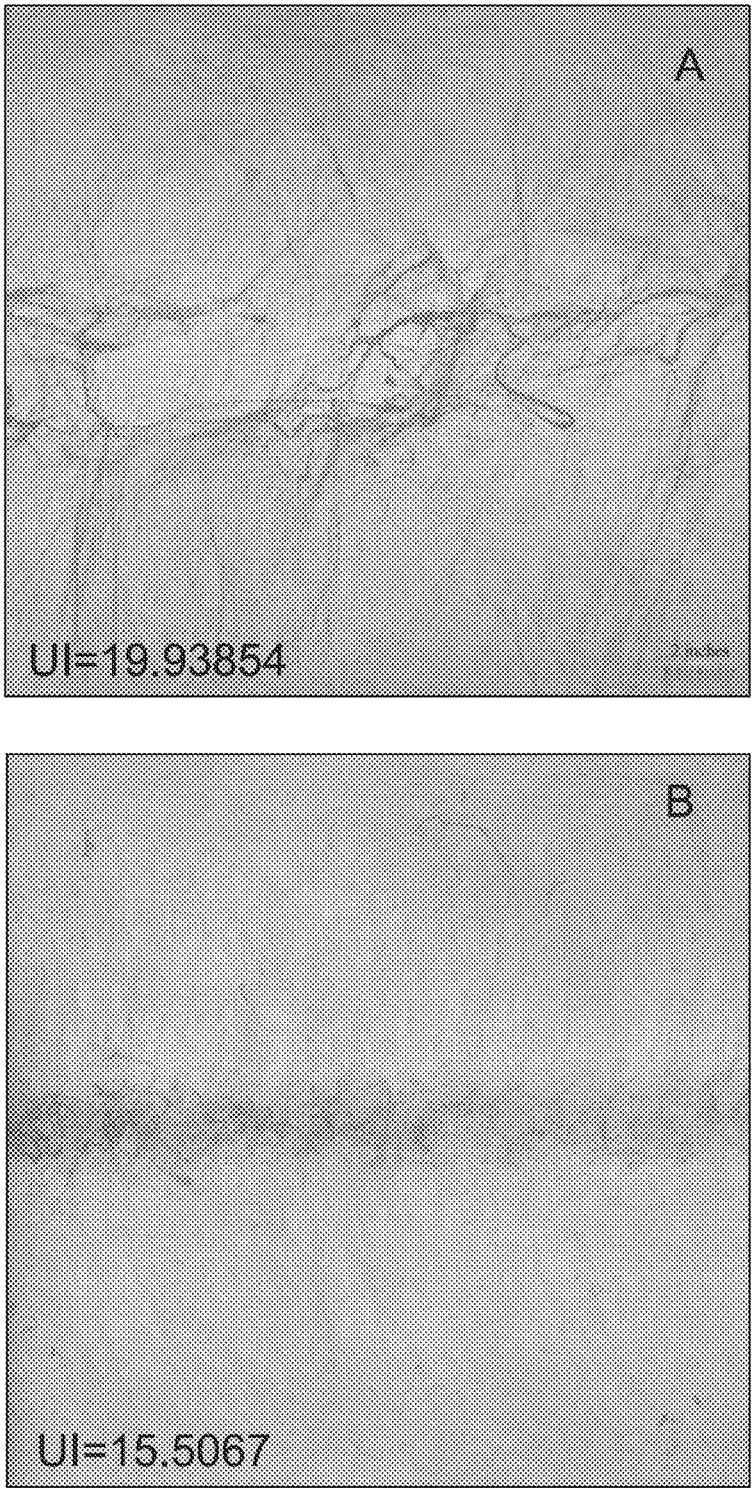
FIG. 18 shows examples of laydown of polybutene webs with and without air.

With the center air through the rotating shaft set at 30° C. and 2 SCFM, and with center upwardly air flow, and without charging, FIG. 18(A) snows the web image with a web uniformity index of UI=19.93854. Fiber bundles appeared in the web.

Figure 19:
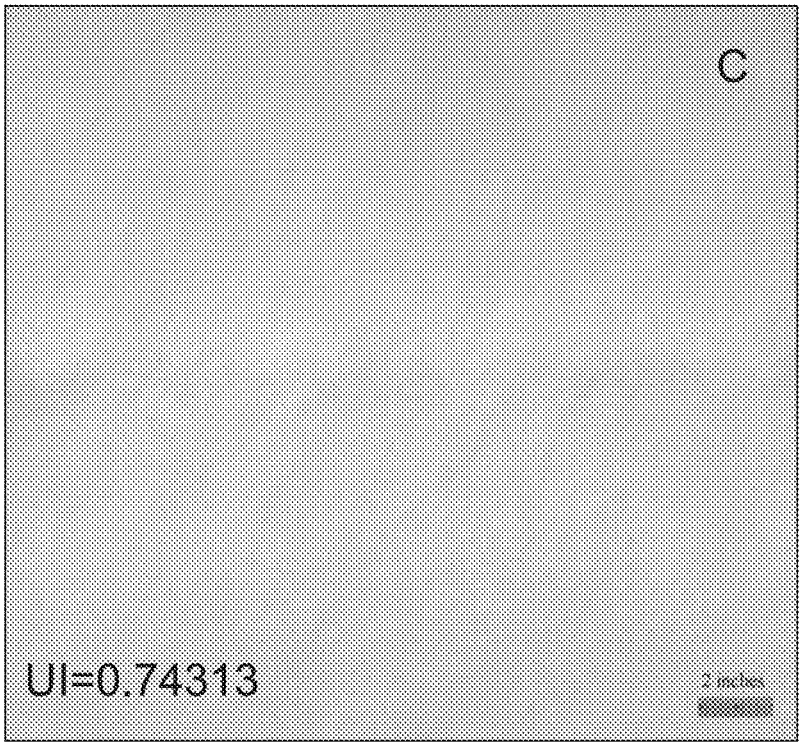
FIG. 19 shows an example of laydown of a polybutene web with air and with electrostatic field.

With dual high voltage charging of +50 kV and 0.6 mA on collector belt, −12 kV and 0.6 mA on corona ring, and without air management, FIG. 18(B) shows that the web uniformity index is UI=15.5067. There was a fiber swirling pattern stripe in the center of the web under the spin disk. With dual charging and air management, FIG. 19 (C) shows that the web uniformity index is UI=0.74313.

Example 6

Continuous fibers were made using a standard ITW TurboDisk atomizer with a special 20 hole turbine plate, and control enclosure for high voltage and turbine speed control from ITW Automotive Finishing Group. The Pulse Track System was used to maintain constant speed of the rotary atomizer during the spinning process. The solution viscosity was 12.5 PaS at 25° C. A 30 cm flat spin disk was used. A spin solution of 12.0% poly (ethylene oxide) with an Mw of about 300,000 and 88.0% water was used. The flow rate of the spin solution was 200 cc/min, and the disk rotation speed was 21,000 rpm. High voltage was provided from a Voltage Master power supply. The high voltage was operated at about 73 kV during this test. The shaping air was set at 25° C. The laydown belt was moving at 20 inch/min.

Figure 20:
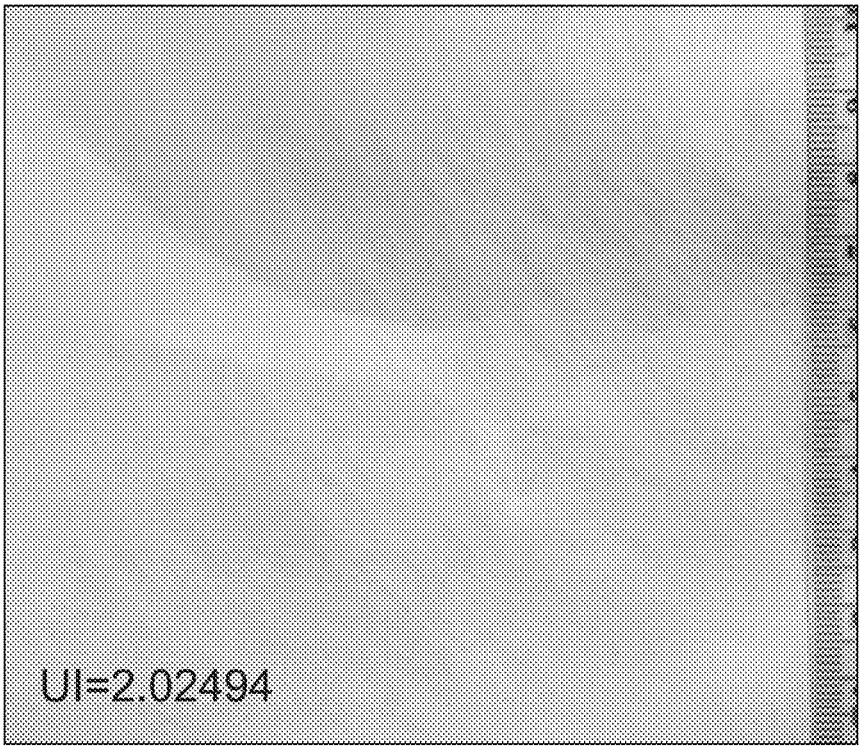
FIG. 20 shows an example of a web laid down from a solution spinning process.

The fiber size was measured from SEM images and the fiber was determined to have an average fiber diameter of 254 nm with a median value of 222 nm. FIG. 20 shows that the web uniformity index was UI=2.02494.

In this specification, unless explicitly stated otherwise or indicated to the contrary by the context of usage, where an embodiment of the subject matter hereof is stated or described as comprising, including, containing, having, being composed of or being constituted by or of certain features or elements, one or more features or elements in addition to those explicitly stated or described may be present in the embodiment. An alternative embodiment of the subject matter hereof, however, may be stated or described as consisting essentially of certain features or elements, in which embodiment features or elements that would materially alter the principle of operation or the distinguishing characteristics of the embodiment are not present therein. A further alternative embodiment of the subject matter hereof may be stated or described as consisting of certain features or elements, in which embodiment, or in insubstantial variations thereof, only the features or elements specifically stated or described are present.

Where a range of numerical values is recited or established herein, the range includes the endpoints thereof and all the individual integers and fractions within the range, and also includes each of the narrower ranges therein formed by all, the various possible combinations of those endpoints and internal integers and fractions to form subgroups of the larger group of values within the stated range to the same extent as if each of those narrower ranges was explicitly recited. Where a range of numerical values is stated herein as being greater than a stated value, the range is nevertheless finite and is bounded on its upper end by a value that is operable within the context of the invention as described herein. Where a range of numerical values is stated herein as being less than a stated value, the range is nevertheless bounded on its lower end by a non-zero value.

In this specification, unless explicitly stated otherwise or indicated to the contrary by the context of usage, (a) lists of compounds, monomers, oligomers, polymers and/or other chemical materials include derivatives of the members of the list in addition to mixtures of two or more of any of the members and/or any of their respective derivatives;

(b) amounts, sizes, ranges, formulations, parameters, and other quantities and characteristics recited herein, particularly when modified by the term "about", may but need not be exact, and may also be approximate and/or larger or smaller (as desired) than stated, reflecting tolerances, conversion factors, rounding off, measurement error and the like, as well as the inclusion within a stated value of those values outside it that have, within the context of this invention, functional and/or operable equivalence to the stated value;

(c) the term "essentially" is defined to mean that, if a parameter is described as being "essentially" in a stated condition or at a stated value, then conditions or numerical values for that parameter that are different from the stated condition or value but that do not affect the functioning of the invention are to be considered within the scope of the description of the parameter as "essentially" at the stated condition or value.

We claim:

1. A method for laying down a nanoweb from a centrifugal spinning process comprising the steps of:

(i) ejecting a polymer melt in air or an inert gas from a surface of a rotating member comprising a disk or cup rotating about an axis and located in a spinning head, wherein molten fibrils exit the surface in a direction essentially perpendicular to the axis of rotation of the disc or cup and into an electric field established between a fiber collector and the spinning head; and wherein the fibrils are attenuated by the centrifugal force and cool to form nanofibers that have a number average fiber diameter of less than 1,000 nm;

(ii) applying a charge to the polymer melt, the molten fibrils, the nanofibers, or any combination of these three locations;

(iii) directing the nanofibers with a shaping air flow towards a collector that has a charge opposite to the charge on the fibers in (ii) above;

(iv) collecting the polymeric nanofibers on the collector;

wherein turbulent motion of air located between the spinning head and the collector is suppressed by air jets supplied by nozzles located on the underside of the rotating member, on the surface facing the collector, and wherein a region exists adjacent to and touching the collector where the motion of the fibers is governed by the potential difference between the nanofibers and the collector and is unaffected by the shaping air flow.

* * * * *